US011478765B2

(12) United States Patent
Boire et al.

(10) Patent No.: US 11,478,765 B2
(45) Date of Patent: Oct. 25, 2022

(54) GEL PRODUCTION SYSTEM AND METHOD

(71) Applicant: GEL SYSTEMS CANADA INC., Saskatoon (CA)

(72) Inventors: James Boire, Saskatoon (CA); Brent Allan Roberts, Saskatoon (CA); Adam Nahachewsky, North Saskatoon (CA)

(73) Assignee: GEL SYSTEMS CANADA INC., Saskatchewan (CA)

( * ) Notice: Subject to any disclaimer, the term of this patent is extended or adjusted under 35 U.S.C. 154(b) by 615 days.

(21) Appl. No.: 16/348,808

(22) PCT Filed: Nov. 8, 2017

(86) PCT No.: PCT/CA2017/051325
§ 371 (c)(1),
(2) Date: May 9, 2019

(87) PCT Pub. No.: WO2018/085925
PCT Pub. Date: May 17, 2018

(65) Prior Publication Data

US 2019/0344230 A1 Nov. 14, 2019

Related U.S. Application Data

(60) Provisional application No. 62/420,376, filed on Nov. 10, 2016.

(51) Int. Cl.

| | |
|---|---|
| ***B01F 33/00*** | (2022.01) |
| ***B01F 33/70*** | (2022.01) |
| ***B01F 23/50*** | (2022.01) |
| ***B01F 35/71*** | (2022.01) |

(52) U.S. Cl.
CPC ..... *B01F 33/70* (2022.01); *B01F 23/54* (2022.01); *B01F 35/711* (2022.01); *B01F 23/56* (2022.01)

(58) Field of Classification Search
CPC ..... B01F 13/06; B01F 3/1228; B01F 33/70; B01F 23/56
See application file for complete search history.

(56) References Cited

U.S. PATENT DOCUMENTS

| | | | | |
|---|---|---|---|---|
| 3,001,652 A | | 9/1961 | Schroeder | |
| 3,179,378 A | | 4/1965 | Zenz | |
| 3,244,407 A | * | 4/1966 | Obergfell | D06F 43/085 366/155.2 |

(Continued)

FOREIGN PATENT DOCUMENTS

| | | | |
|---|---|---|---|
| CA | 780113 | A | 3/1968 |
| WO | WO2011145023 | | 11/2011 |

OTHER PUBLICATIONS

International Search Report for PCT/CA2017/051325, dated Jan. 15, 2018, 3 pages.

*Primary Examiner* — Anshu Bhatia
(74) *Attorney, Agent, or Firm* — Brooks Kushman P.C.

(57) ABSTRACT

A gel production system and method, in which a powder configured for mixing with an aqueous solvent such as water to form a gel is metered into a pressurized air stream to fluidize the powder, and the fluidized powder is injected into a pressurized water supply. The fluidized powder is at a greater pressure than the water supply, helping to hydrate the fluidized powder in the water, and the water supply plus fluidized powder are subsequently mixed in a mixing chamber to form the gel.

19 Claims, 5 Drawing Sheets

(56) References Cited

U.S. PATENT DOCUMENTS

| | | | | |
|---|---|---|---|---|
| 3,777,775 | A | 12/1973 | Handleman | |
| 3,819,157 | A * | 6/1974 | Markfelt | B01F 35/711 366/101 |
| 5,544,951 | A | 8/1996 | Alack | |
| 2004/0256106 | A1* | 12/2004 | Phillippi | B01F 3/1228 166/308.2 |
| 2012/0279572 | A1* | 11/2012 | Pedersen | B01F 15/0202 137/1 |
| 2013/0142006 | A1* | 6/2013 | Saffioti | B29B 7/60 366/153.3 |

* cited by examiner

GEL PRODUCTION SYSTEM AND METHOD

CROSS-REFERENCE TO RELATED APPLICATIONS

This application is the U.S. national phase of PCT Application No. PCT/CA2017/051325 filed on Nov. 8, 2017, which claims the benefit of U.S. Provisional Application No. 62/420,376 filed on Nov. 10, 2016, the disclosures of which are incorporated in their entirety by reference herein.

FIELD OF THE INVENTION

The present invention relates to the preparation of gels, and specifically gels derived from hydration of particulate materials such as powders.

BACKGROUND OF THE INVENTION

It is known in the art of gel production to form gels from a mixture of water and dry base powders. It is known in the art of firefighting specifically to employ gels with fire-retardant properties, and many such gels are known to the skilled person, as well as methods for forming such gels from dry base powders.

For example, U.S. Pat. No. 3,777,775 to Handleman discloses a system for creating a firefighting slurry/solution by introducing an air/powder mixture into a water stream, and using an eductor vacuum to achieve mixing.

In a further example, Canadian Patent No. 780,113 to Katzer et al. teaches introducing powder into an atmospheric air stream driven by Venturi forces, and then introducing a water stream to the air/powder stream, again employing a vacuum (eductor) to achieve the desired mixing.

However, it is believed that many prior art systems result in incomplete hydration of the base powder, or "clumping" of the powder when introduced to the water supply and mixed. In order to optimize the fire-retardant properties of the resultant gel, it will be clear to those skilled in the art that maximizing the number of hydrated powder particles is desirable as non-hydrated powder particles do not manifest the desirable fire-retardant properties. The prior art systems fail to achieve this goal. As well, eductor systems are known to be limited to low-pressure output, as pressures exceeding 12 to 13 psi may cause the eductor to stop working, since the delta pressure can generally only be between 0 and 15 psi. Further, in many prior art systems precision metering of powder is an issue because the conventional use of a Venturi is inadequate as a metering technique.

What is needed, therefore, is a system and method for producing a gel from a base powder, in which the hydration of powder particles is optimized when compared to prior art systems.

SUMMARY OF THE INVENTION

The present invention therefore seeks to provide a system and method in which the powder particles are metered, fluidized within an air stream to disperse the metered particles, and then injected into a water stream for hydration. However, the pressure of the air/powder stream is greater than the pressure of the water stream, to enhance hydration of individual powder particles rather than collapse and clumping.

According to a first broad aspect of the present invention, then, there is provided a system for producing a gel, the system comprising:

a mixing chamber;

a water subsystem comprising:

a pressurized water supply for generating a pressurized water stream at a first pressure and supplying the pressurized water stream to the mixing chamber; and a powder fluidization subsystem comprising:

a pressurized air supply for generating a pressurized air stream at a second pressure;

a powder supply for supplying a powder configured for mixing with water to produce the gel; and a metering valve for metering the powder from the powder supply into the pressurized air stream to produce a fluidized powder supply at the second pressure;

wherein the fluidized powder supply is introduced to the pressurized water stream in the mixing chamber to hydrate the powder in the fluidized powder supply therein to form the gel; and wherein the second pressure is greater than the first pressure.

In some exemplary embodiments of the first aspect, the powder supply comprises a pressure vessel, and the system may further comprise a vacuum pressurization subsystem to supply the powder to the pressure vessel.

The mixing chamber preferably physically constrains the pressurized water supply and the fluidized powder supply for mixing thereof. In some preferred embodiments, the mixing chamber comprises a pipe section substantially parallel with a flow direction of the pressurized water stream upon exiting the water subsystem.

The water subsystem preferably comprises a water pump for pressurizing the pressurized water supply and supplying the pressurized water stream to the mixing chamber, and the flow and pressure of the pressurized water stream is preferably monitored respectively by a process water flow meter and a process water pressure transducer.

The pressurized air supply may be achieved by an air compressor, with the pressure of the fluidized powder supply monitored by an air/powder pressure transducer.

In some exemplary embodiments, the second pressure is measured by an air/powder pressure transducer and the first pressure is measured by a process water pressure transducer, to ensure that the second pressure is greater than the first pressure.

The metering valve may be powered by a variable speed drive.

The gel is preferably discharged from the mixing chamber into a tank for storage and transport, such as for subsequent use as a fire-retardant gel in a firefighting operation.

According to a second broad aspect of the present invention, there is provided a method for producing a gel, the method comprising the steps of:

a. providing a pressurized water stream at a first pressure;
b. providing a powder configured for mixing with water to produce the gel;
c. providing a pressurized air stream at a second pressure, the second pressure greater than the first pressure;
d. metering the powder into the pressurized air stream to fluidize the powder into a fluidized powder supply; and
e. introducing the fluidized powder supply at the second pressure into the pressurized water stream to hydrate the powder in the fluidized powder supply therein to produce the gel.

In some exemplary embodiments of the second aspect, the method further comprises the step of providing a mixing chamber for receiving the pressurized water stream and the fluidized powder supply.

The method preferably further comprises monitoring the first pressure and the second pressure. Further, a flow volume of the pressurized water stream is preferably monitored, wherein the metering of the powder is conducted at a flow rate/volume based on the flow volume and a selected mixture concentration. The selected mixture concentration may be 100:1 ratio by weight of water to powder, although other concentrations may be appropriate in the view of the skilled person.

Some exemplary methods further comprise the step after step e. of ceasing introduction of the fluidized powder supply into the pressurized water stream if either the second pressure falls below the first pressure, or providing of the pressurized water stream or the pressurized air stream ceases.

In some exemplary embodiments the method further comprises discharging the gel for storage and transport.

A detailed description of an exemplary embodiment of the present invention is given in the following. It is to be understood, however, that the invention is not to be construed as being limited to this embodiment. The exemplary embodiment is directed to a particular application of the present invention, while it will be clear to those skilled in the art that the present invention has applicability beyond the exemplary embodiment set forth herein.

BRIEF DESCRIPTION OF THE DRAWINGS

In the accompanying drawings, which illustrate an exemplary embodiment of the present invention.

Figure 1A:
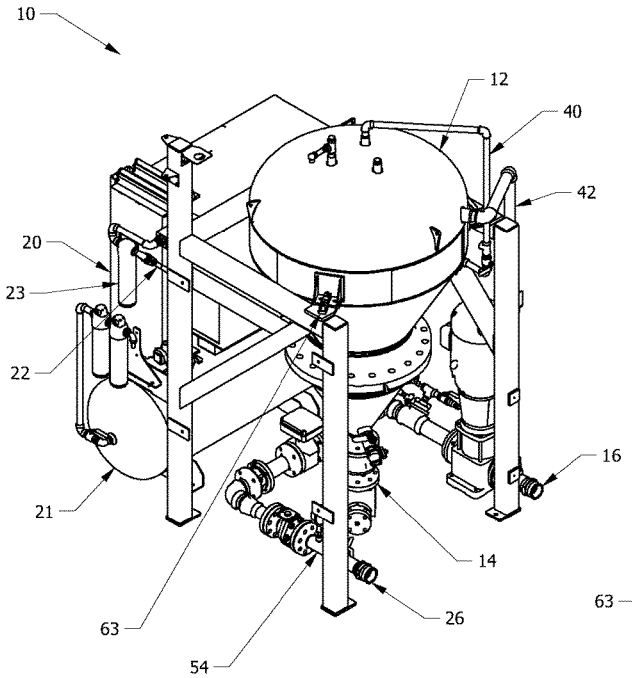
FIGS. 1*a*, 1*b* and 1*c* are perspective views of an exemplary embodiment of the present invention.
Figure 1B:
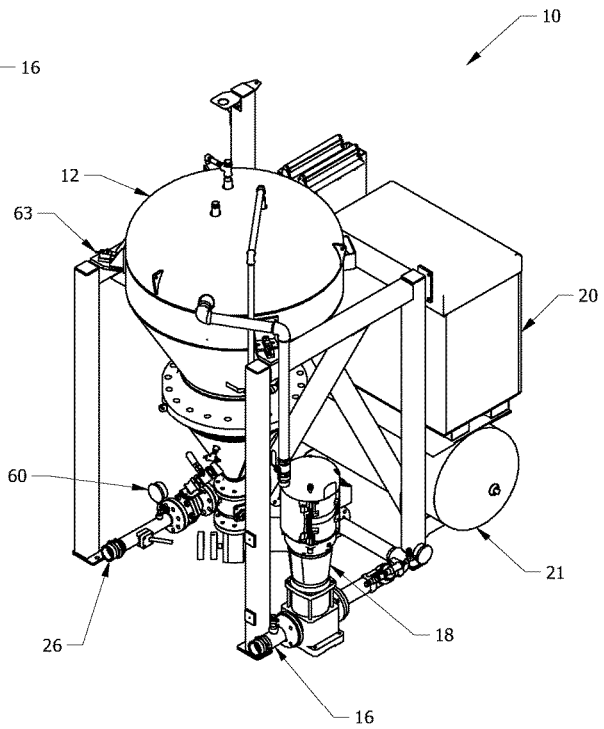
Figure 1C:
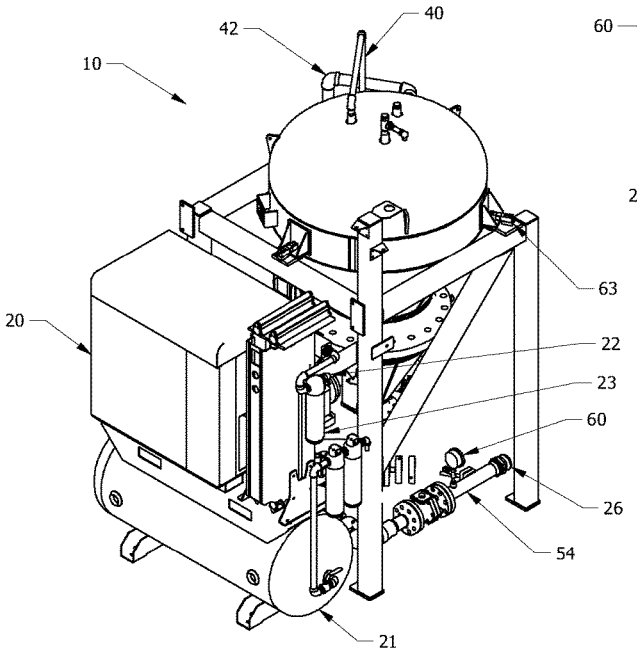
Figure 2A:
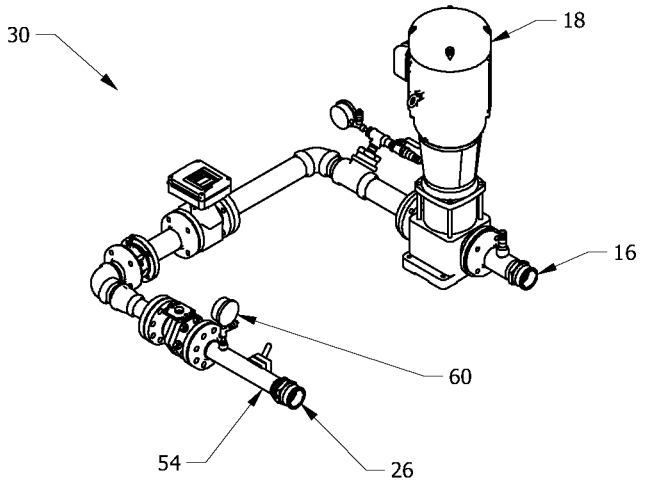
FIGS. 2*a*, 2*b* and 2*c* are perspective views of the mixing circuit of the exemplary embodiment.
Figure 2B:
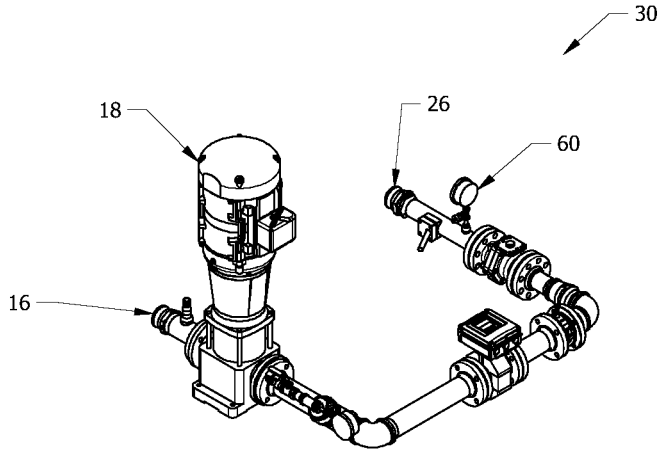
Figure 2C:
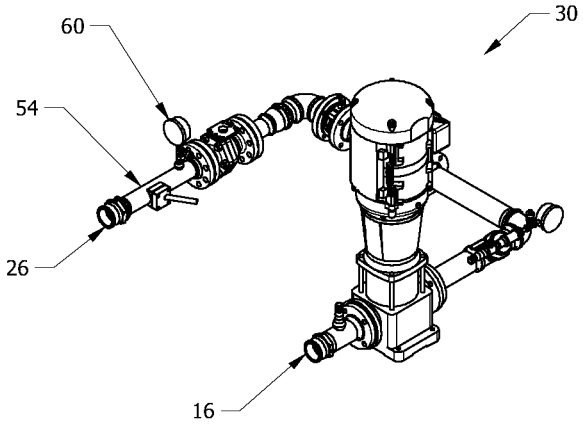
Figure 3A:
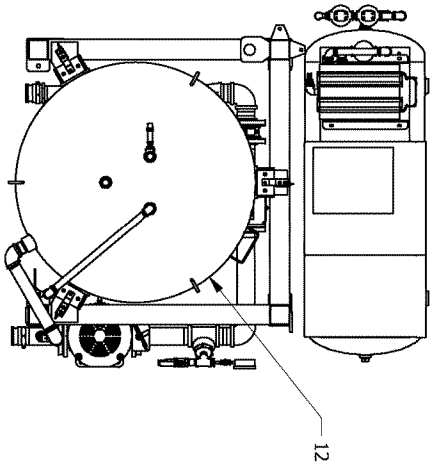
FIGS. 3*a*, 3*b* and 3*c* are top plan, side elevation and front elevation views of the exemplary embodiment.
Figure 3B:
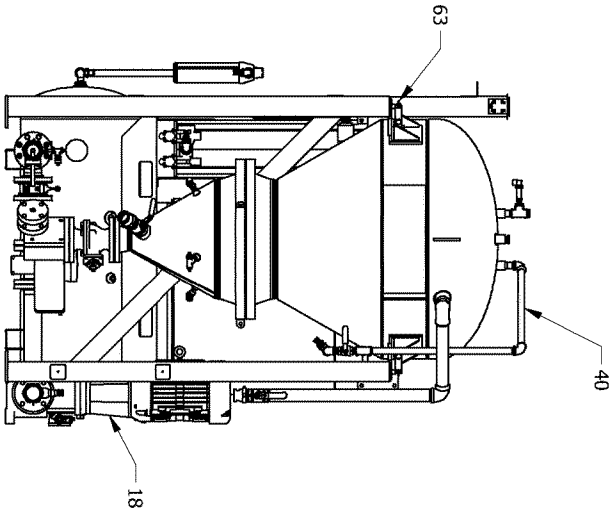
Figure 3C:
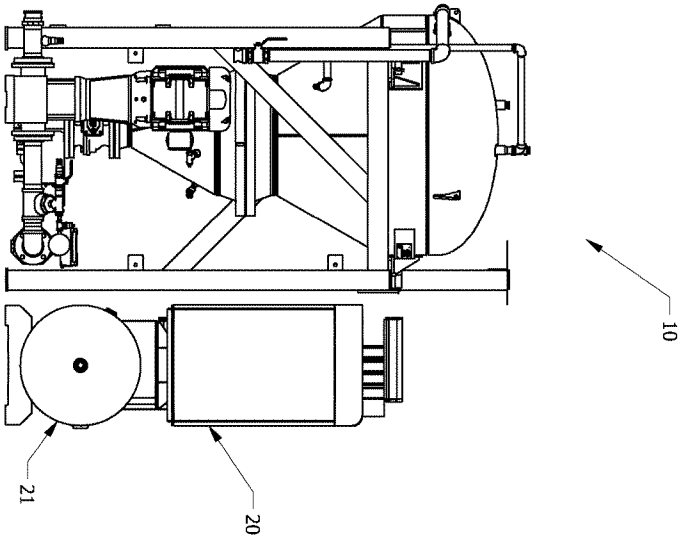

An exemplary embodiment of the present invention will now be described with reference to the accompanying drawings.

DETAILED DESCRIPTION OF EXEMPLARY EMBODIMENT

Throughout the following description specific details are set forth in order to provide a more thorough understanding to persons skilled in the art. However, well known elements may not have been shown or described in detail to avoid unnecessarily obscuring the disclosure. The following description of an example of the technology is not intended to be exhaustive or to limit the invention to the precise form of any exemplary embodiment. Accordingly, the description and drawings are to be regarded in an illustrative, rather than a restrictive, sense.

Turning to FIGS. 1*a* to 3*c*, a gel production system 10 is illustrated, and specifically a system 10 for producing a fire-retardant gel for use in firefighting operations. It will be clear to those skilled in the art that other useful gels could be produced using the present invention and the exemplary embodiments described herein. The system 10 comprises a pressure vessel 12 for supplying powder (not shown) for use in generating the desired fire retardant gel, and a mixing circuit 30 for introducing the fluidized powder supply to the water stream, as is described below. The system 10 conceptually consists of three primary functional sub-systems, namely a water sub-system for providing a pressurized water stream to hydrate particulate powder, an air/powder sub-system for fluidizing the powder as part of a pressurized air stream, and a mixing sub-system for enabling physically constrained mixing of the fluidized powder and water to form a gel for use as a fire retardant material, preferably but not necessarily for dispersal from aircraft.

To fill the pressure vessel 12 with powder, a vacuum process may be employed. While a vacuum fill process is described below, it will be clear to those skilled in the art that other filling means may be used, such as, for non-limiting examples, a combined positive pressure and vacuum (push-pull) process, a solely positive pressure process, or a process of manually introducing powder into the vessel 12 via a sealable filling aperture (not shown in the accompanying drawings). As is illustrated in the process flow diagram of FIG. 4, the vessel pressurization valve 32 would first be closed, followed by the vessel discharge valve 34. The vent/vacuum valve 36 would then be opened in the exemplary embodiment. A first hose would be connected between the vacuum 38 and the vent/vacuum pipe 40 of the pressure vessel 12, and a second hose would be connected between the loading pipe 42 of the vessel 12 and a supply tote 28 containing the powder. Once a vessel pressure transducer 68 determines that the vessel 12 is at atmospheric pressure, the loading valve 44 can be opened and the vacuum 38 can be started. The tote pressurization valve 46 is then opened to introduce air to the tote 28 (or to introduce compressed air from the air compressor 20 in a combined positive pressure and vacuum powder loading process, to pressurize the tote 28) after which the tote egress valve 29 (shown in FIG. 4) can be opened, transporting powder from the tote 28 to the vessel 12. Once the tote 28 is empty or a vessel level indicator 56 indicates that the vessel 12 is filled to a desired level, the valves 46, 29 and 44 can again be closed, the vacuum 38 can be shut off and valve 36 can be closed.

Use of the system 10 for gel production employs air pressure. The valve 32 is opened, and once the vessel pressure transducer 68 indicates that the vessel 12 has reached a desirable pressure level the vessel discharge valve 34 can be opened. Preparation of the gel can then begin.

With reference to the piping and instrumentation diagram of FIG. 5, as well as FIGS. 1*a* to 3*c*, the mixing stage will now be described. The water discharge valve 48 and air/powder discharge valve 52 are opened. The variable speed drive of the water pump 18 is then started, and the water flow and water and air pressures are monitored; the water flow and pressure are monitored by a process water flow meter 58 and a process water pressure transducer 60 respectively; and the air pressure is monitored by an air and powder pressure transducer 62. The air pressure is achieved in the exemplary embodiment by an air compressor 20 with an outlet 22, as can best be seen in FIGS. 1*a* to 1*c* and 3*a* to 3*c*, with an inline downstream receiver tank 21 (for pressure maintenance; shown in FIGS. 3*c* and 4), a dryer 23 (for humidity control; shown in FIGS. 1*a*, 1*c* and 4) and an outlet 22. As can be seen in the Figures, various flow meters, valves and pressure gauges would be integrated as necessary in the judgment of the skilled person in any given embodiment or implementation of the present invention. As indicated above, the air pressure detected at transducer 62 must be greater than the water pressure indicated at transducer 60. Water is pumped through the water discharge valve 48 into the mixing chamber 54. While the exemplary mixing chamber 54 is a pipe section that is in line with the flow of water, it will be clear to those skilled in the art that other types of mixing apparatus could be used with other embodiments of the present invention.

Figure 4:
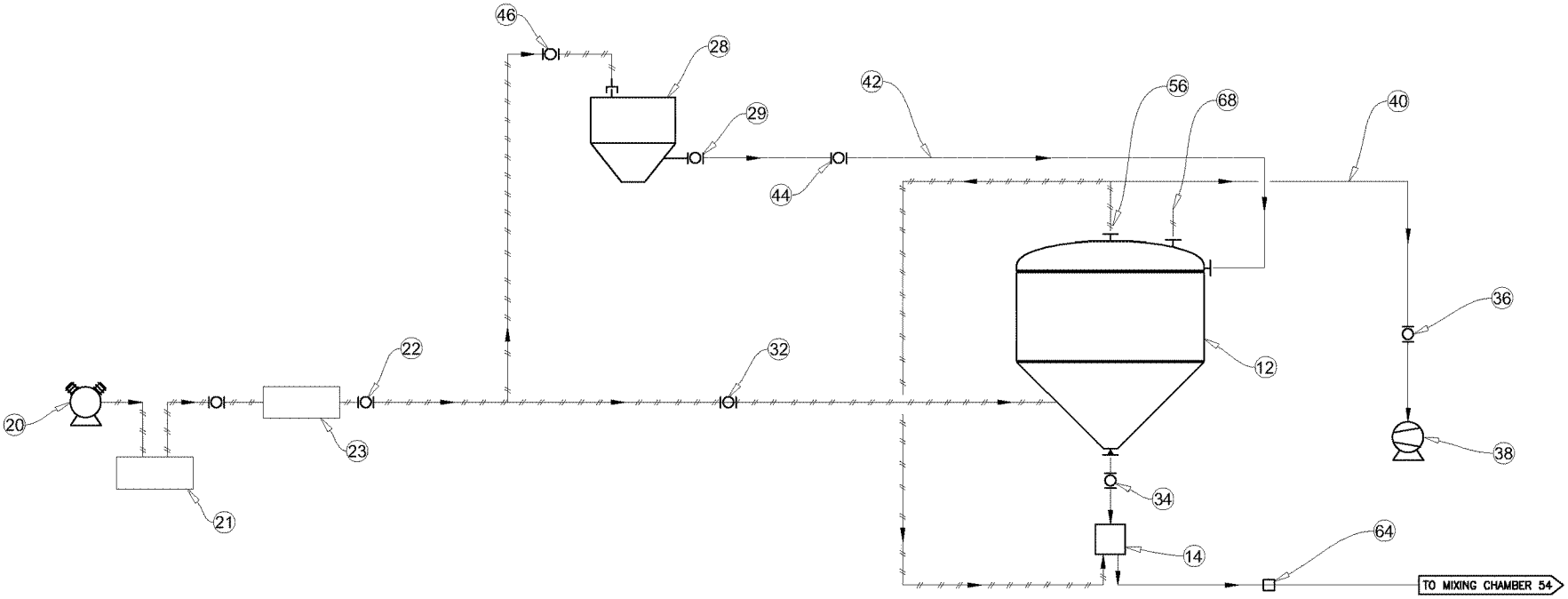
FIG. 4 is a process flow diagram of the air/powder subsystem of the exemplary embodiment.
Figure 5:
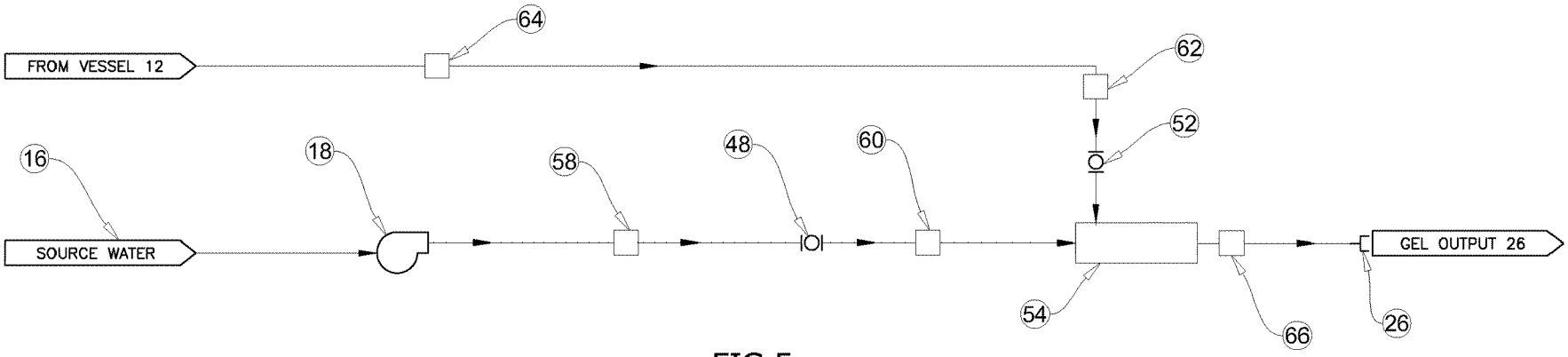
FIG. 5 is a piping and instrumentation diagram of the water subsystem of the exemplary embodiment.

The variable speed drive for the metering valve 14 is then powered up, and powder flows from the vessel 12 through the valve 14 at a pre-determined flow rate/volume based on water volume from the process water flow meter 58 and the desired mix ratio, which is confirmed by a powder mass change measurement calculated using a weighing device 63 comprising load cells (shown in FIG. 1*a*) or a powder mass flow meter 64 (shown in FIG. 4). The powder particles fall into the air stream and are fluidized to form a dispersed fluidized powder stream. This air/powder stream is then injected into the water stream in the mixing chamber 54. As stated above, the pressure of the air/powder stream is higher than the water stream pressure, which allows the fluidized powder particles to be forcefully injected into the water in a dispersed manner, with the particles separated to a greater extent than in prior art systems and thus allowing for a greater extent of particle hydration. The pressure differential between the air/powder stream and the water stream can be adjusted to generate a gel with desirable characteristics. To form a stable gel for firefighting purposes using, for example, FireIce™ sold by GelTech Solutions, Inc., the pressure difference should be approximately 1-3 p.s.i. Various commercially available powders could be used with embodiments of the present invention, for example said FireIce™ sold by GelTech Solutions, Inc. In the exemplary embodiment a 100:1 ratio by weight of water-to-powder is preferred, but the skilled person will be able to determine an appropriate ratio depending on the type of powder and specific apparatus employed for gel preparation, as well as any specifications particular to the specific application.

The gel forms by the hydration of the powder, and the resultant gel is output at the gel outlet 26. The specific gravity of the gel may or may not be monitored and reported before discharge to a receptacle, at a gel viscosity meter 66. In this exemplary embodiment the gel is discharged into an aircraft payload tank for eventual air delivery to a fire such as a forest fire, but embodiments of the present invention could be employed in other settings.

Throughout loading, the process water flow meter 58, process water pressure transducer 60, powder mass flow meter 64 and air/powder pressure transducer 62 are continuously monitored. Alternatively, the process water flow meter 58 and the process water pressure transducer 60 can be monitored together with powder depletion measured as a function of vessel 12 powder mass change as determined from the weighing device 63 and the air/powder pressure transducer 62. If flow in either water flow or powder flow/depletion ceases, or if the water pressure becomes greater than the air pressure, the process is shut down. When sufficient gel has been produced and discharged, the metering valve 14 and water pump 18 are shut down, and the water and air/powder discharge valves 48 and 52 are closed.

As will be clear from the foregoing, embodiments of the present invention may provide a number of desirable advantages over the prior art. For example, fluidizing the powder in a high-pressure air stream can act to better disperse the powder particles in the water stream upon mixing of the streams, which may thus avoid or reduce clumping of the powder, thereby better optimizing the gel production. Other advantages will be clear to the skilled person, such as the ease with which a system like the above exemplary embodiment can be made portable for use with remote firefighting activity.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof "herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A system for producing a gel, the system comprising:
a mixing chamber;
a water subsystem comprising:
a connection to a source of pressurized water supply for generating a positively pressurized water stream at a first pressure and for supplying the positively pressurized water stream to the mixing chamber in a flow direction; and
a powder fluidization subsystem comprising:
a pressurized air supply for generating a pressurized air stream at a second pressure;
a powder supply for supplying a powder configured for mixing with water to produce the gel; and
a metering valve for metering the powder from the powder supply into the pressurized air stream to produce a fluidized powder supply at the second pressure;
wherein the fluidized powder supply is introduced to the positively pressurized water stream in the mixing chamber as the positively pressurized water stream moves in the flow direction to hydrate the powder in the fluidized powder supply therein to form the gel; and
wherein the second pressure is greater than the first pressure.

2. The system of claim 1 wherein the powder supply comprises a pressure vessel.

3. The system of claim 1 wherein the mixing chamber physically constrains the pressurized water supply and the fluidized powder supply for mixing thereof.

4. The system of claim 2 further comprising a vacuum pressurization subsystem to supply the powder to the pressure vessel.

5. The system of claim 1 wherein the water subsystem comprises a water pump for pressurizing the pressurized water supply and supplying the positively pressurized water stream to the mixing chamber.

6. The system of claim 1 wherein flow and pressure of the positively pressurized water stream is monitored respectively by a process water flow meter and a process water pressure transducer.

7. The system of claim 1 wherein the pressurized air supply is achieved by an air compressor.

8. The system of claim 1 wherein pressure of the fluidized powder supply is monitored by an air/powder pressure transducer.

9. The system of claim 1 wherein the second pressure is measured by an air/powder pressure transducer and the first pressure is measured by a process water pressure transducer, to ensure that the second pressure is greater than the first pressure.

10. The system of claim 1 wherein the mixing chamber comprises a pipe section substantially parallel with the flow direction of the positively pressurized water stream.

11. The system of claim 1 wherein the metering valve is powered by a variable speed drive.

12. The system of claim 1 wherein the gel is discharged from the mixing chamber into a tank for storage and transport.

13. A method for producing a gel, the method comprising the steps of:
providing a positively pressurized water stream at a first pressure and directing the positively pressurized water stream in a flow direction;
providing a powder configured for mixing with water to produce the gel;
providing a pressurized air stream at a second pressure, the second pressure greater than the first pressure;
metering the powder into the pressurized air stream to fluidize the powder into a fluidized powder supply; and
introducing the fluidized powder supply at the second pressure into the positively pressurized water stream as the positively pressurized water stream moves in the flow direction to hydrate the powder in the fluidized powder supply therein to produce the gel.

14. The method of claim 13 further comprising the step of providing a mixing chamber for receiving the positively pressurized water stream and the fluidized powder supply.

15. The method of claim 13 further comprising discharging the gel for storage and transport.

16. The method of claim 13 further comprising monitoring the first pressure and the second pressure.

17. The method of claim 13 further comprising monitoring a flow volume of the positively pressurized water stream, wherein the metering of the powder is conducted at a flow rate/volume based on the flow volume and a selected mixture concentration.

18. The method of claim 17 wherein the selected mixture concentration is 100:1 ratio by weight of water to powder.

19. The method of claim 13 further comprising the step after step e of ceasing introduction of the fluidized powder supply into the positively pressurized water stream if either the second pressure falls below the first pressure, or providing of the positively pressurized water stream or the pressurized air stream ceases.

* * * * *